US008172544B2

(12) United States Patent
Kido et al.

(10) Patent No.: US 8,172,544 B2
(45) Date of Patent: May 8, 2012

(54) OPERATION CONTROL DEVICE FOR VACUUM PUMP AND METHOD FOR STOPPING OPERATION THEREOF

(75) Inventors: Koichi Kido, Tokyo (JP); Tetsuro Sugiura, Tokyo (JP); Hiroki Furuta, Tokyo (JP)

(73) Assignee: Ebara Corporation, Tokyo (JP)

( * ) Notice: Subject to any disclaimer, the term of this patent is extended or adjusted under 35 U.S.C. 154(b) by 866 days.

(21) Appl. No.: 12/249,285

(22) Filed: Oct. 10, 2008

(65) Prior Publication Data

US 2009/0097984 A1 Apr. 16, 2009

(30) Foreign Application Priority Data

Oct. 12, 2007 (JP) ..... 2007-267032

(51) Int. Cl.
*F04B 49/00* (2006.01)

(52) U.S. Cl. ..... 417/12; 417/42; 417/44.1; 417/53

(58) Field of Classification Search ..... 313/12, 313/42, 44.1, 53
See application file for complete search history.

(56) References Cited

U.S. PATENT DOCUMENTS

2006/0198735 A1* 9/2006 Iijima et al. ..... 417/44.1

FOREIGN PATENT DOCUMENTS

JP 2004-138047 A 5/2004
WO 2004-038222 A1 5/2004

* cited by examiner

*Primary Examiner* — Vip Patel
(74) *Attorney, Agent, or Firm* — Westerman, Hattori, Daniels & Adrian, LLP

(57) ABSTRACT

To provide an operation control device for a vacuum pump and a method for stopping the operation of the vacuum pump that make it possible to effectively remove products, resulting from solidification and liquefaction of gas in a casing and possibly hindering the rotation of a pump rotor, so that the vacuum pump may be started normally. An operation control device 10 for a vacuum pump having a pump rotor 1 disposed in a casing 2 for free rotation includes a pump rotor control section 15 for controlling the rotation of the pump rotor 1. The pump rotor control section 15 has a function to, after a pump stop action has been taken, rotate the pump rotor 1 in forward and/or reverse directions according to a predetermined timing pattern and then stop the pump rotor 1.

3 Claims, 13 Drawing Sheets

OPERATION CONTROL DEVICE FOR VACUUM PUMP AND METHOD FOR STOPPING OPERATION THEREOF

BACKGROUND OF THE INVENTION

1. Technical Field

This invention relates to an operation control device for a vacuum pump and a method for stopping the operation of the vacuum pump. This invention relates in particular to an operation control device for a vacuum pump for use in evacuating the interior of a chamber of a semiconductor manufacturing apparatus or the like, and to a method for stopping the operation of the vacuum pump.

2. Related Art

Vacuum pumps are widely used in semiconductor manufacturing apparatuses to evacuate gas used in the semiconductor manufacturing process from the chamber and to make vacuum environment in the chamber. As for vacuum pumps, such types are known as the positive-displacement type provided with pump rotors of Roots or screw type.

Generally, the positive-displacement vacuum pump is provided with a pair of pump rotors disposed in a casing and an electric motor to drive and rotate the pump rotors. Between the paired pump rotors and between the pump rotors and the casing, very narrow clearances are formed; and the pump rotors are adapted to rotate without contacting the casing. As the paired pump rotors rotate synchronously in opposite directions, gas in the casing is moved from the suction side to the delivery side; and the gas is evacuated from the chamber or the like connected to the suction port.

Some of gasses used in the semiconductor manufacturing process contain constituents that solidify or liquefy at low temperatures. Generally, as the above-mentioned vacuum pump generates compression heat in the process of moving the gas, the vacuum pump in operation is heated up to a certain temperature. Accordingly, as long as the vacuum pump is kept at high temperatures, even when a gas containing the above constituents is evacuated using the above vacuum pump, the constituents do not solidify or liquefy, so that favorable evacuation is carried out.

[Patent Document 1]

JP-A-2004-138047

However, when the vacuum pump stops operation and its temperature lowers gradually, the constituents contained in the gas solidify or liquefy and end up in accumulating in gaps between the pump rotors and between the pump rotors and the casing (the solidified or liquefied constituents will be hereinafter called "products"). When the temperature lowers further, the pump rotors and the pump casing shrink, and gaps between them become narrower, and the products end up in being squeezed between those gaps. As a result, there have been problems as follows: The squeezed products hinder the rotation of the pump rotors, so that the pump rotors cannot be rotated with the starting torque of the electric motor, and the vacuum pump fails to restart. Moreover, under such a condition, not only the vacuum pump cannot be restarted, but also the electric motor is overheated due to overload and the vacuum pump is hindered from being operated safely.

Besides, in recent years, a motor drive technique has been in progress in which an induction motor using a frequency converter, a brushless DC motor, etc. are driven. When such a motor drive technique is used in the vacuum pump, the motor torque for starting the vacuum pump is finally determined with the capacity of components used in the frequency converter. As a result, the condition for starting the vacuum pump is becoming severer because the electric motor cannot produce torque greater than a certain limit.

This invention has been made in view of the above point. Therefore, the object of this invention is to provide an operation control device for a vacuum pump and a method for stopping the operation of the vacuum pump, making it possible to effectively remove the products when the vacuum pump is going to be stopped and normally start the vacuum pump even when the solidified or liquefied products in the casing may otherwise hinder the rotation of the pump rotors.

SUMMARY OF THE INVENTION

To achieve the above object, as shown in FIG. 1 for example, an operation control device 10 related to aspect (1) of the present invention for a vacuum pump having a pump rotor 1 rotatably disposed in a casing 2 comprises:

a pump rotor control section 15 for controlling a rotation of the pump rotor 1, the pump rotor control section 15 has a function to, after a pump stop action has been taken, rotate the pump rotor 1 in forward and/or reverse directions according to a predetermined timing pattern and then stop the pump rotor 1.

When the operation of the vacuum pump is to be stopped and as the time passes after a pump stop action has been taken, the vacuum pump cools down, the gas evacuated from the chamber and present in the vacuum pump solidifies or liquefies to become products that collect in very narrow gaps between the paired pump rotors and between the pump rotors and the casing. Here, however, because the pump rotor control device causes the pump rotors to rotate in forward and/or reverse directions according to the predetermined timing pattern, the products tending to collect receive forces in forward and reverse rotary directions and are removed effectively. As a result, the products do not present at all or in only a very small amount in very narrow gaps between the pump rotors and between the pump rotors and the casing, when the vacuum pump is to be started, so that the vacuum pump may be started smoothly.

Aspect (2) of the present invention is the operation control device 10 for a vacuum pump as recited in aspect (1), as shown in FIGS. 6, 11 for example, the rotating speed of the pump rotor 1 in forward and/or reverse directions may be arbitrarily set with the timing pattern.

As the rotating speed of the pump rotors in forward and/or reverse directions may be arbitrarily set with the timing pattern, the speed may be set optimally according to the type of the gas and the production state of the products, so that the products may be effectively removed.

Aspect (3) of the present invention is the operation control device 10 for a vacuum pump as recited in aspect (1), as shown in FIG. 4, for example, the predetermined timing pattern is set to repetitively start and stop the operation of the pump rotor 1 at specified time intervals t1, t2.

As the cycle of starting and stopping the operation of the pump rotors is repeated at specified time intervals according to the predetermined timing pattern, or the operation is made intermittently, it is possible to effectively remove the above products.

Aspect (4) of the present invention is the operation control device 10 for a vacuum pump as recited in aspect (1), as shown in FIG. 11, for example, the predetermined timing pattern is set to repetitively start and stop the operation of the pump rotor 1 at specified time intervals t1 or t2 and to rotate the pump rotor in forward and/or reverse directions during the operation.

The cycle of starting and stopping the operation of the pump rotors is repeated at specified time intervals according to the predetermined timing pattern, and the pump rotors are rotated in forward or reverse direction during the operation. In other words, the operation is made intermittently, and the pump rotors are rotated in forward or reverse direction during the operation. Therefore, the above products may be removed further effectively.

Aspect (5) of the present invention is the operation control device 10 for a vacuum pump as recited in aspect (1), as shown in FIG. 6, for example, the rotating speed of the pump rotor 1 is set in the timing pattern to be reduced at a constant rate with the lapse of time, and the pump rotor 1 is stopped when a predetermined speed is reached.

Reducing the rotating speed of the pump rotors by a constant rate with the lapse of time according to the predetermined timing pattern as described above causes the pump rotors to rotate at high speeds to remove the products in the state in which the vacuum pump temperature lowers rapidly and products are produced in large amount. On the other hand, in the state in which less exhaust gas remains and products are produced in small amount, the rotating speed is reduced. Thus, the pump rotor stop control is made to match the production state of the products.

Aspect (6) of the present invention is the operation control device 10 for a vacuum pump as recited in aspect (1), as shown in FIG. 7, for example, the rotating speed of the pump rotor 1 is set to be reduced stepwise with the lapse of time.

As described above, because the rotating speed of the pump rotors is set to be reduced in steps, like the above case, the pump rotors are rotated at high speeds to remove the products in the state in which the vacuum pump temperature lowers rapidly and products are produced in large amount. In the state in which less exhaust gas remains and products are produced in small amount, the rotating speed is reduced. Thus, the pump rotor stop control is made to match the production state of the products.

A method related to aspect (7) of the present invention for stopping operation of a vacuum pump having a pump rotor 1 rotatably disposed in a casing 2 as shown in FIG. 10, for example, comprises:

the step that, after a pump stop action has been taken, the pump rotor 1 is rotated in forward and/or reverse directions according to a predetermined timing pattern, and then the pump rotor 1 is stopped.

As described above, because the pump rotors are rotated in forward and/or reverse directions according to the predetermined timing pattern, the products tending to collect in very narrow gaps between the pump rotors and between the pump rotors and the casing receive forces in forward and/or reverse rotating directions, and are effectively removed, making it possible to smoothly start the vacuum pump.

According to this invention, when the operation of the vacuum pump is to be stopped, the pump rotors are first rotated in forward and/or reverse directions according to the predetermined timing pattern, and then stopped. Therefore, even in the case in which solidified or liquefied products or the like may hinder the rotation of the pump rotors, the products are effectively removed, so that the vacuum pump may be started normally.

The basic Japanese Patent Application No. 2007-267032 filed on Oct. 12, 2007 is hereby incorporated in its entirety by reference into the present application.

The present invention will become more fully understood from the detailed description given hereinbelow. The other applicable fields will become apparent with reference to the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the present claims constitute, therefore, a part of the present invention in the sense of doctrine of equivalents.

DETAILED DESCRIPTION OF THE PREFERRED EMBODIMENT

Embodiments of the invention will be described below in reference to drawings. While the description is made on embodiments of the operation control device and the operation stopping method for a vacuum pump used for evacuating gas from the chamber of the semiconductor manufacturing apparatus, the vacuum pump, to which the operation control device and the operation stopping method according to the invention are applied, is not limited to such a pump.

First Embodiment

Figure 1:
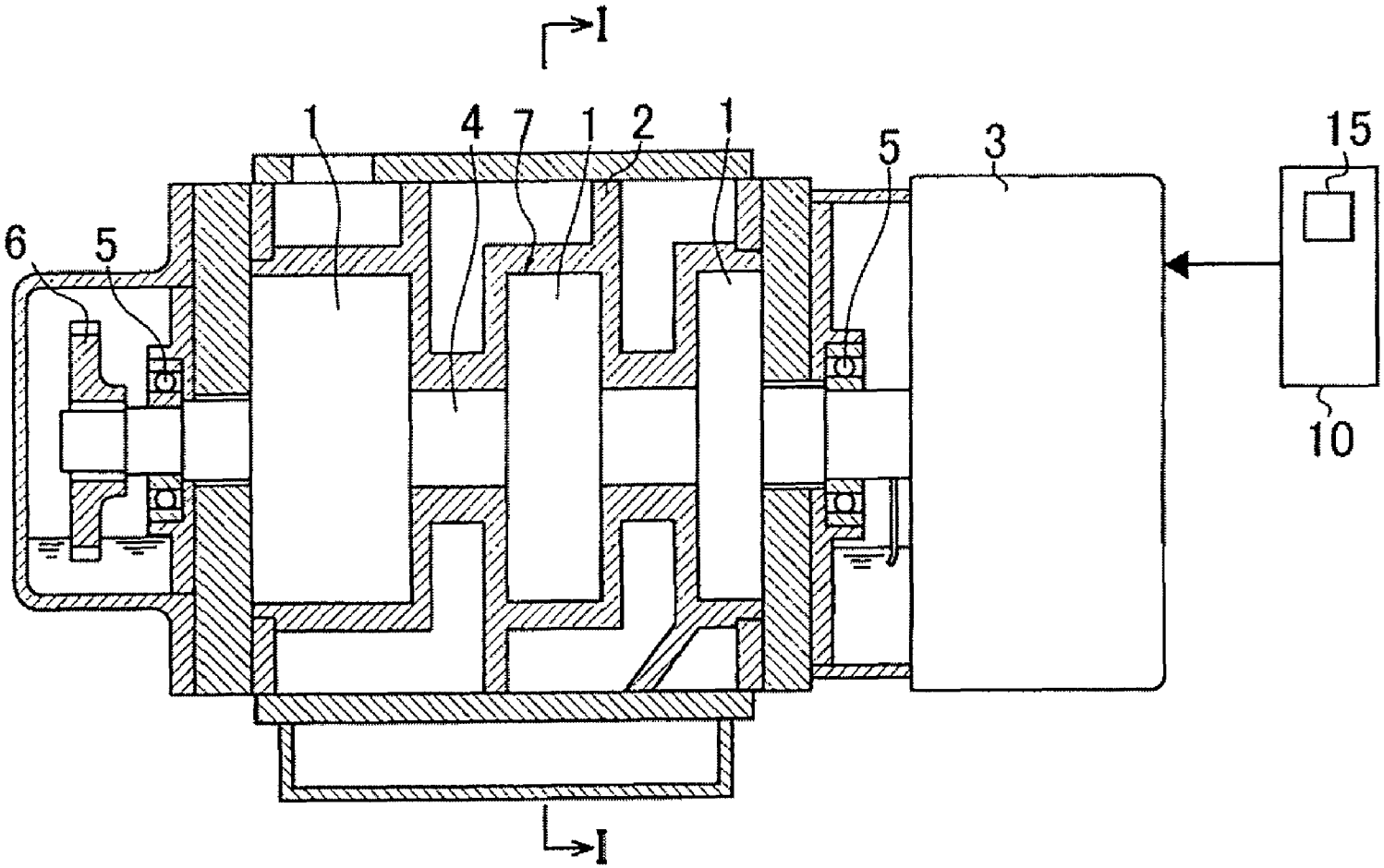
FIG. 1 is a sectional view showing a constitution example of a vacuum pump using an operation control device according to the invention.
Figure 2:
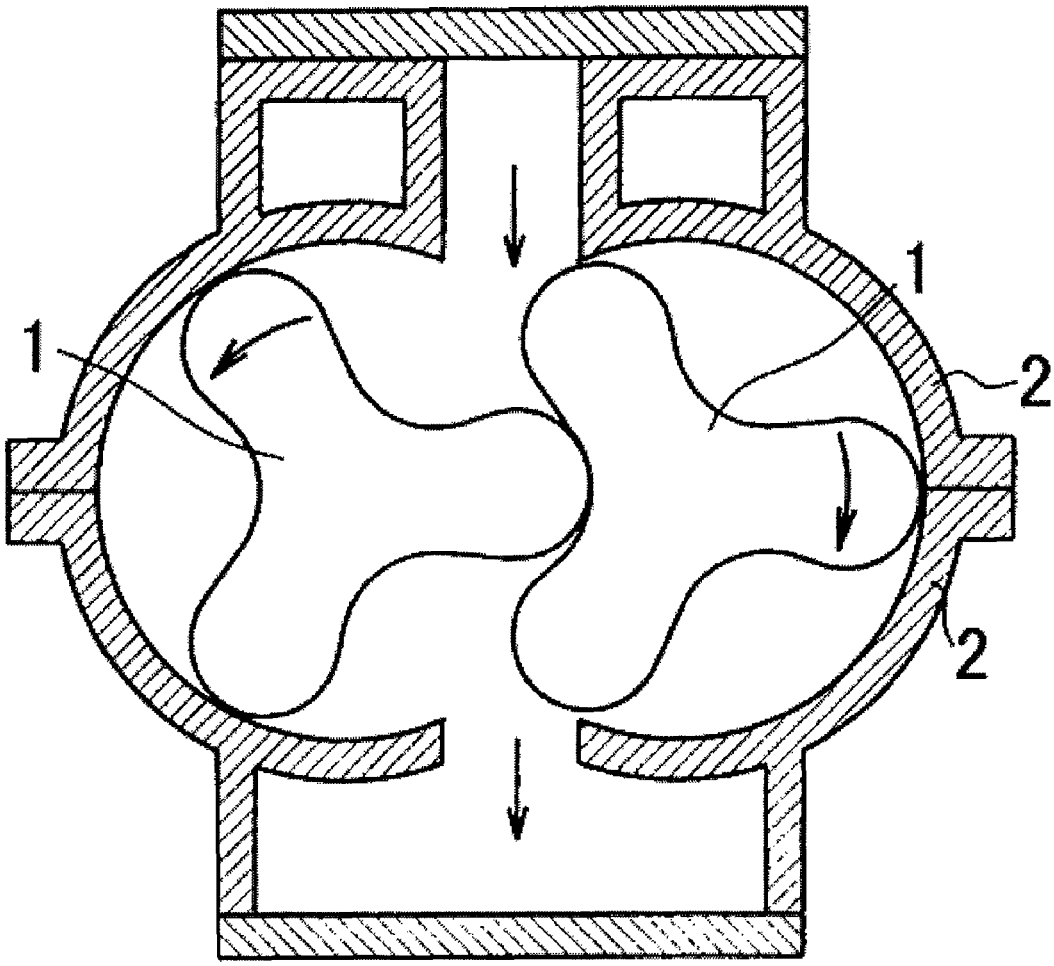
FIG. 2 is a sectional view taken along the line I-I in FIG. 1.

FIGS. 1 and 2 are views showing a constitution example of a vacuum pump using an operation control device according to the invention. FIG. 1 is a sectional view. FIG. 2 shows the sectional view along the line I-I in FIG. 1. As shown, this vacuum pump includes: a pair of pump rotors 1, a casing 2 having an exhaust chamber 7 accommodating the pump rotors 1, and an electric motor 3 for driving and rotating the pump rotors 1. The casing 2 is provided with an inlet (not shown) for suctioning gas and an outlet (not shown) for exhausting gas. Each of the paired pump rotors 1 is fixed to a shaft 4 supported to be rotatable through a bearing 5.

One shaft 4 is fixed to a motor rotor (not shown) around which is disposed a motor stator (not shown). The electric motor 3 is made up of the motor rotor and the motor stator. In this embodiment, the electric motor 3 is an induction motor. At an end of each shaft 4 is fixed a timing gear 6. With these timing gears 6, the paired pump rotors 1 are adapted to rotate synchronously in directions opposite to each other. The paired pump rotors 1 are adapted to rotate without contacting the casing 2 because very narrow gaps are formed between the pump rotors 1, and between the pump rotors 1 and the inside surface of the exhaust chamber 7 of the casing 2.

With the vacuum pump of the above constitution, as the electric motor 3 drives and rotates the paired pump rotors 1, gas is suctioned through the inlet (not shown), moved along the pump rotors 1, and delivered out of the outlet (not shown). As the gas is continuously moved from the inlet to the outlet side, gas in the chamber connected to the inlet is evacuated. This chamber is built in the semiconductor manufacturing apparatus.

As shown in FIGS. 1 and 2, the vacuum pump is provided with an operation control device 10 for controlling the operation of the vacuum pump. The operation control device 10 is internally provided with a pump rotor control section 15 for controlling rotation and stop action of the pump rotors 1.

Figure 3:
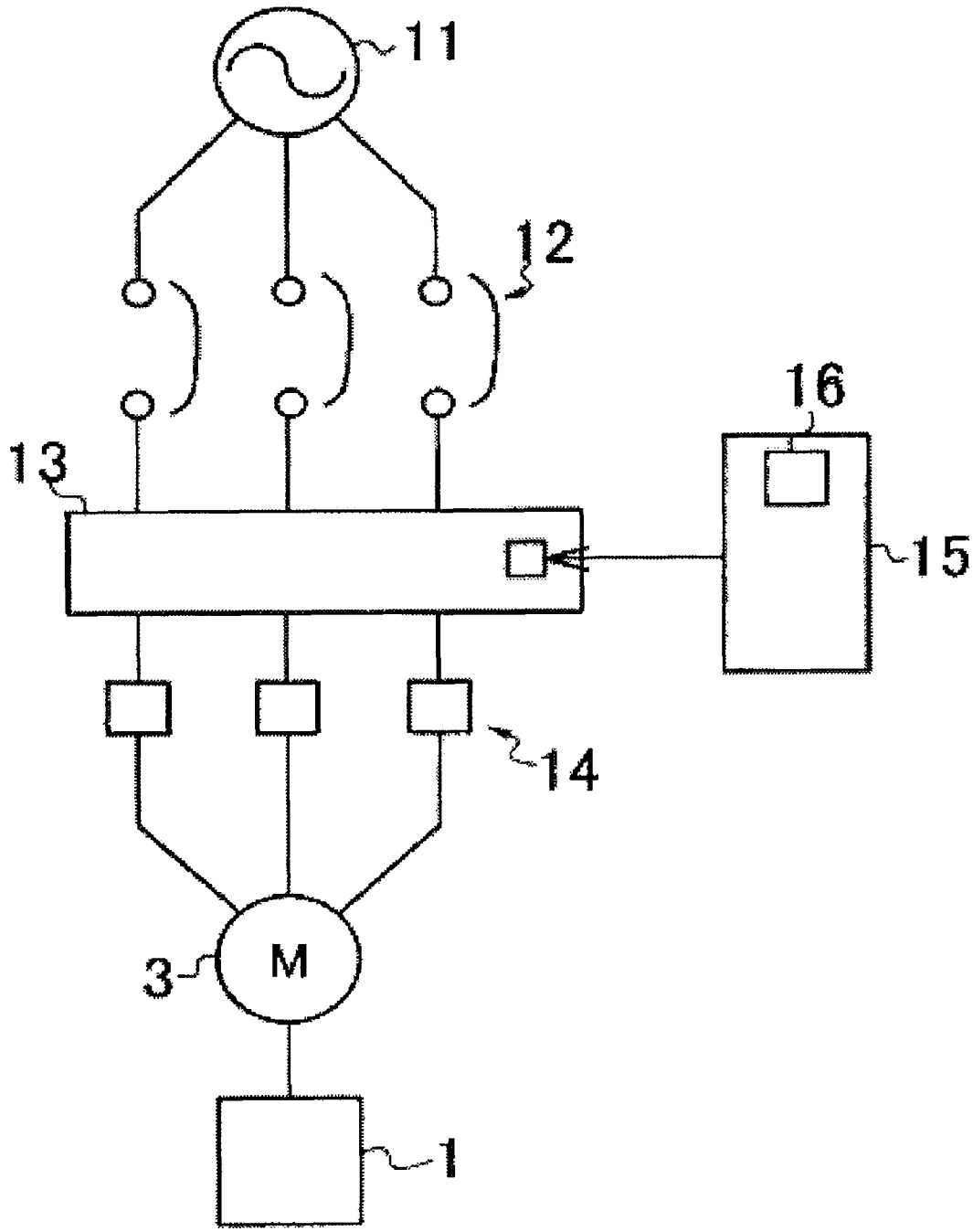
FIG. 3 is a diagram showing a constitution example of a motor drive circuit of the vacuum pump controlled with the operation control device according to the invention.

FIG. 3 is a diagram showing a constitution example of a motor drive circuit controlled with the operation control device 10. As shown in FIG. 3, the motor drive circuit is made up of: a 3-phase power source 11, an electric leakage breaker (ELB) 12, an electromagnetic contactor 13, and a thermal protector 14. The 3-phase power source 11 is connected through the electric leakage breaker (ELB) 12 to the electromagnetic contactor 13. The electromagnetic contactor 13 is connected through the thermal protector 14 to the electric motor 3. The electromagnetic contactor 13 is connected to the pump rotor control section 15 of the operation control device 10 for controlling rotation and stop action of the pump rotors 1 (only one pump rotor is shown in FIG. 3). Incidentally, the electric leakage breaker (ELB) may be replaced with a circuit breaker (CB).

The pump rotor control section 15 is connected to an operation stop switch (not shown) for the vacuum pump. When the operation stop switch is operated while the vacuum pump is in operation, a stop command is sent from the pump rotor control section 15 to the electromagnetic contactor 13. The electromagnetic contactor 13 operates upon receiving the stop command to shut off 3-phase power supplied from the 3-phase power source 11 to the electric motor 3. Thus, the electric motor 3 stops operation to stop the vacuum pump. The thermal protector 14 works when the electric motor 3 is overloaded to stop electric current supplied from the 3-phase power source 11 to the electric motor 3, and stop the operation of the vacuum pump. Thus, the electric motor 3 is prevented from being overloaded and overheated.

Figure 4:
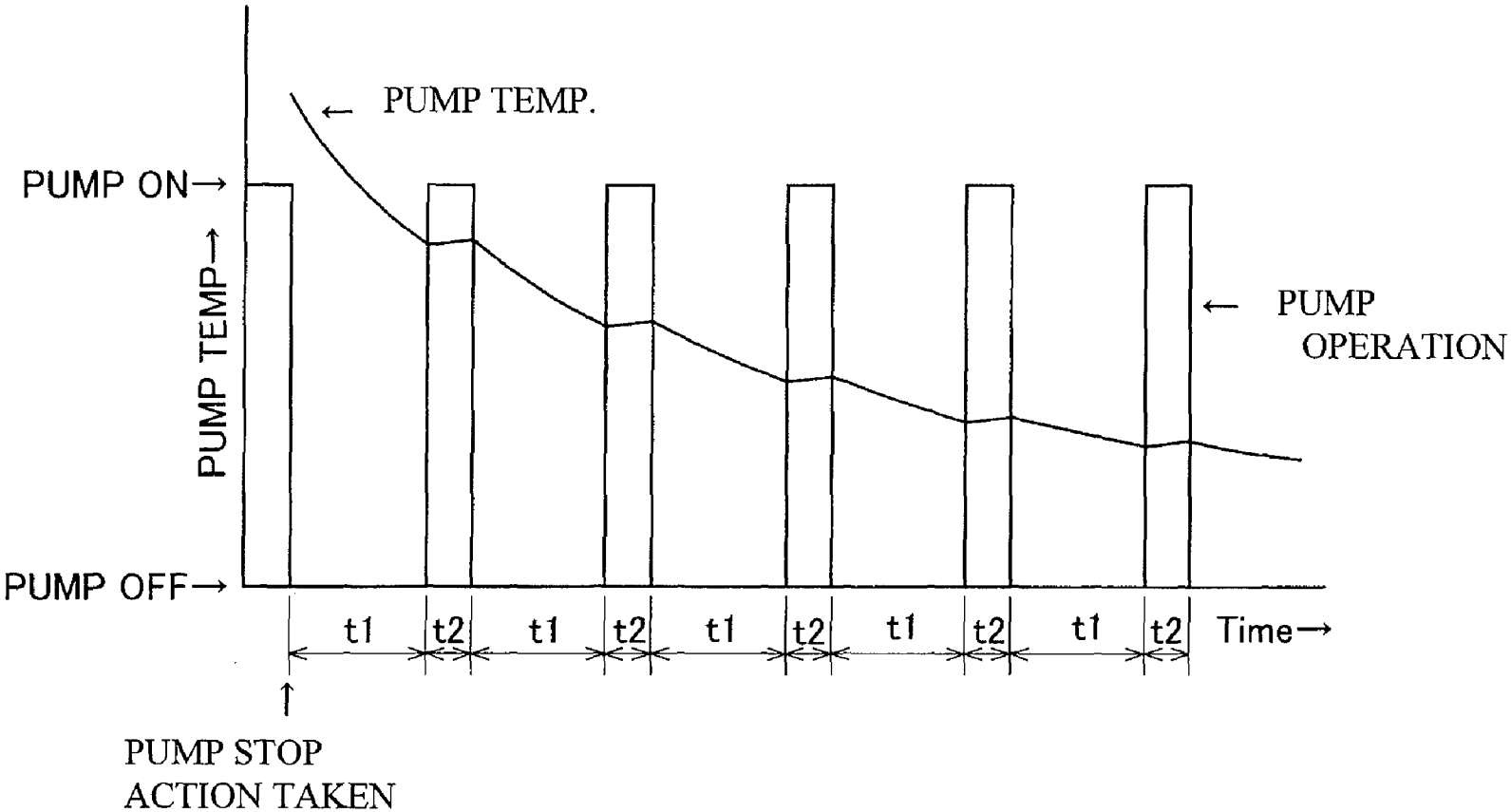
FIG. 4 is a chart showing a pump stop control pattern of the operation control device according to the invention.

In the pump rotor control section 15 is memorized a pump stop control pattern (timing pattern for controlling to stop the pump) for turning on and off the vacuum pump with the lapse of time after a vacuum pump operation stop action is taken by operating the operation stop switch. When a signal is given to take the vacuum pump stop action, using a built-in timer 16 in the pump rotor control section 15, the pump stop control pattern of FIG. 4 is implemented to repeat the cycle of starting and stopping the operation of the vacuum pump; the vacuum pump is stopped for a period of t1 after the pump stop action is taken, then operated for a period of t2, and so on. In this way, the pump rotors 1 are repetitively rotated and stopped. In this embodiment, the pattern of the timer 16 is set so that the pump rotors 1 are driven in the order of forward rotation (rotation in forward direction), stop, and forward rotation. Actual rotating speed of the pump rotors 1 decreases gradually due to inertia. FIG. 4 illustrates motion of the pump rotors 1 with neglecting the inertia force.

When the pump rotors 1 rotate in forward direction, one pump rotor 1 rotates in one direction (for example clockwise) while the other rotates in the opposite direction (for example counterclockwise). Here, gas is suctioned through the inlet into the casing, moved toward the outlet, and discharged out of the outlet. In other words, the forward direction of rotation of the pump rotors 1 means the direction of rotation of the pump rotors 1 that moves gas in the casing 2 from the gas inlet toward the outlet.

As described above, when the vacuum pump is to be stopped, the pump rotors 1 are stopped, and operation is resumed to rotate again the pump rotors 1. In this way, it is possible to apply forces of the pump rotors 1 to the products precipitating along with decrease in temperature of the vacuum pump in the gaps between the pump rotors 1 and the casing 2. Thus, because squeeze of the products due to shrinkage is prevented from occurring and the products are removed, the vacuum pump may be started smoothly. Here, if a pattern is set to repeat rotation and stopping of the pump rotors 1 for several cycles, it will be possible to remove the products more securely. Once the vacuum pump is started normally, the pump rotors 1 rotate in forward direction in steady state to evacuate gas.

Second Embodiment

Figure 5:
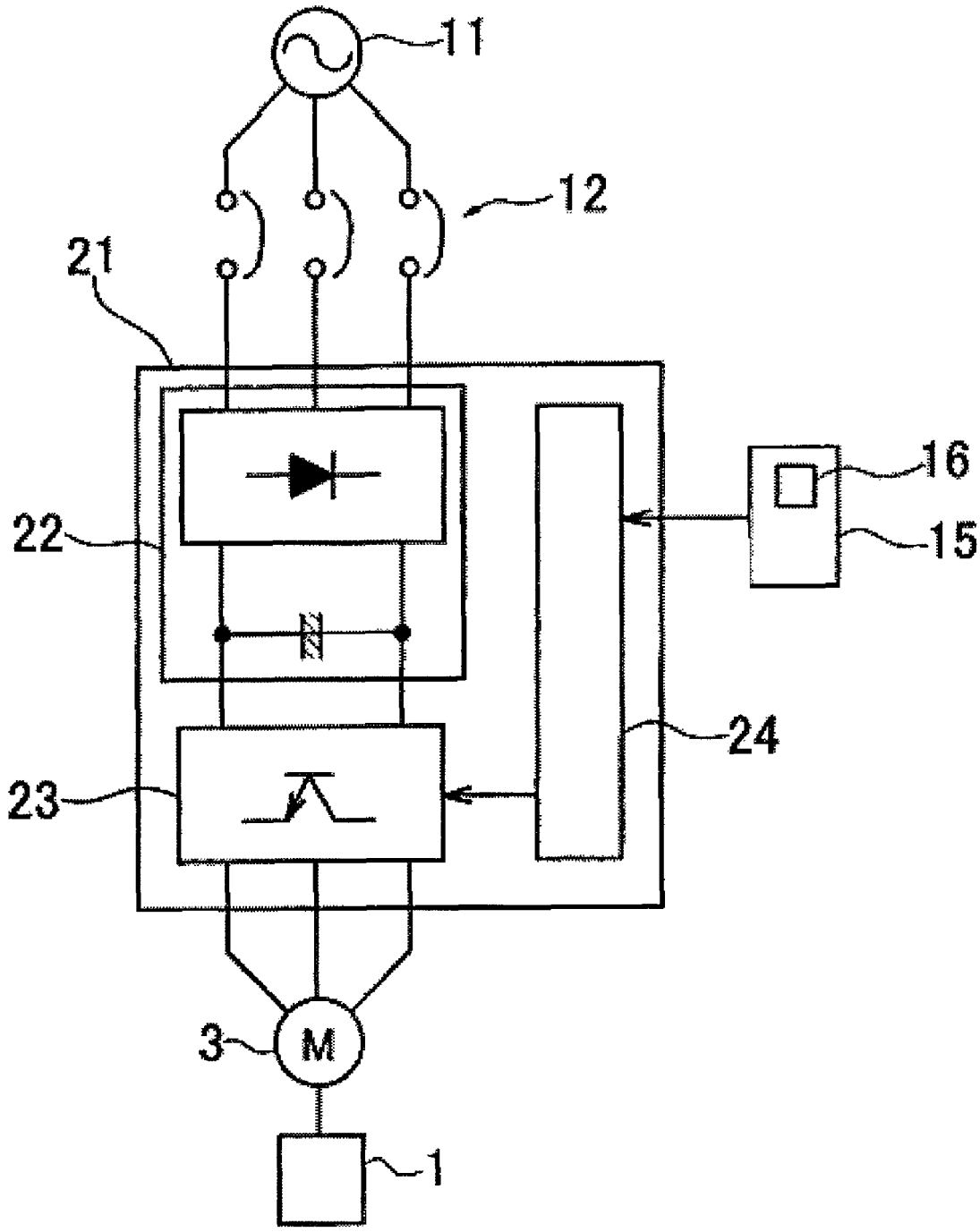
FIG. 5 is a diagram showing a constitution example of a motor drive circuit of the vacuum pump controlled with the operation control device according to the invention.

The vacuum pump used in a second embodiment is the same in constitution as that shown in FIGS. 1 and 2. Therefore, description of the vacuum pump is omitted. FIG. 5 is a diagram showing a constitution example of a motor drive circuit controlled with the operation control device 15. As shown, the motor drive circuit is made up of: the 3-phase power source 11, the electric leakage breaker (ELB) 12, and a frequency converter 21. The 3-phase power source 11 is connected through the electric leakage breaker (ELB) 12 to the frequency converter 21. The frequency converter 21 is connected to the electric motor 3. The frequency converter 21 is made up of: a rectifier 22, a power transistor section 23 for producing current waveforms for rotating the electric motor 3, and a frequency conversion control section 24 for controlling the frequency converter 21. The frequency converter 21 is also connected to the pump rotor control section 15 for controlling operation and stop action of the pump rotors 1.

Figure 6:
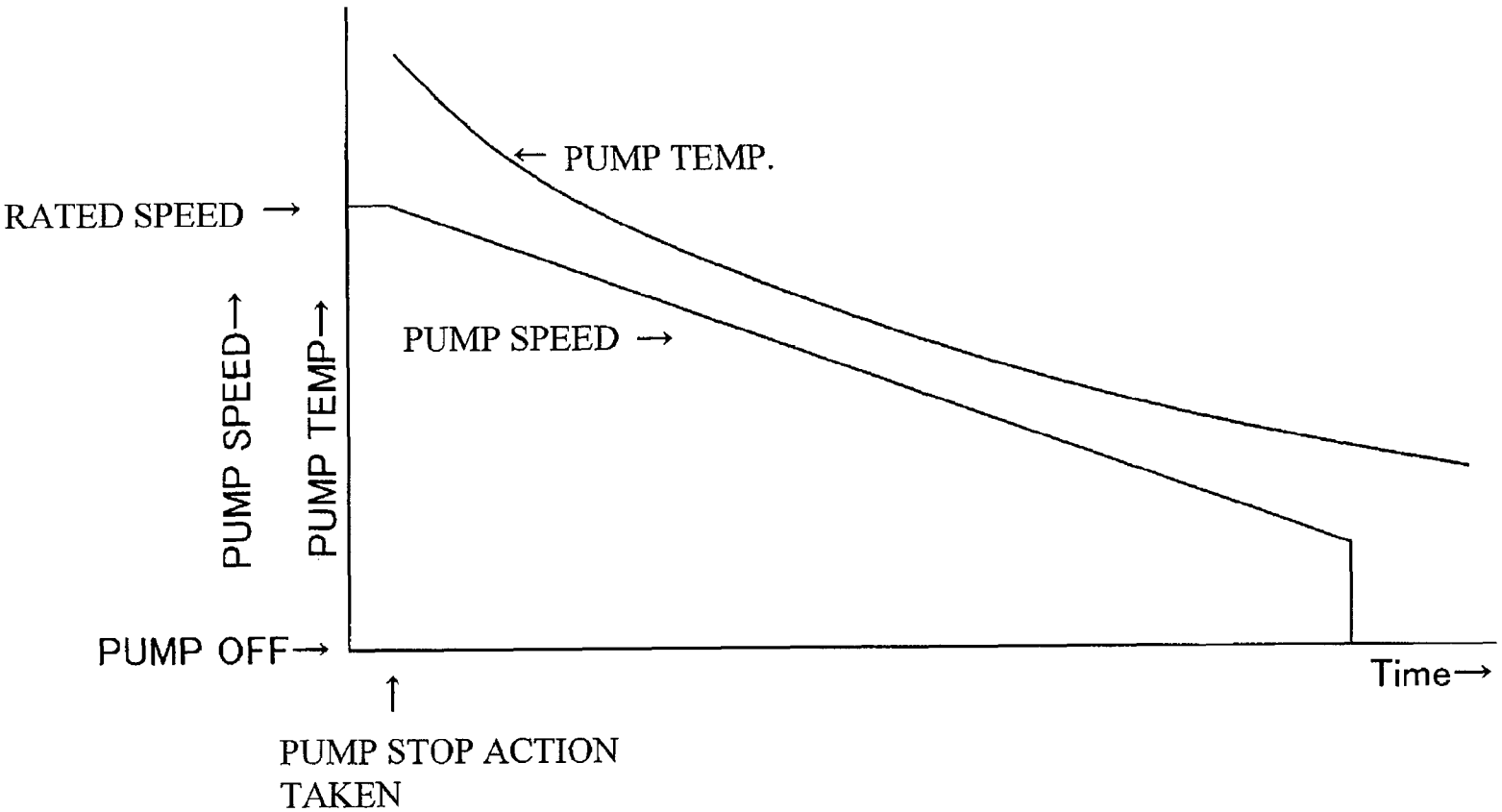
FIG. 6 is a chart showing a pump stop control pattern of the operation control device according to the invention.
Figure 7:
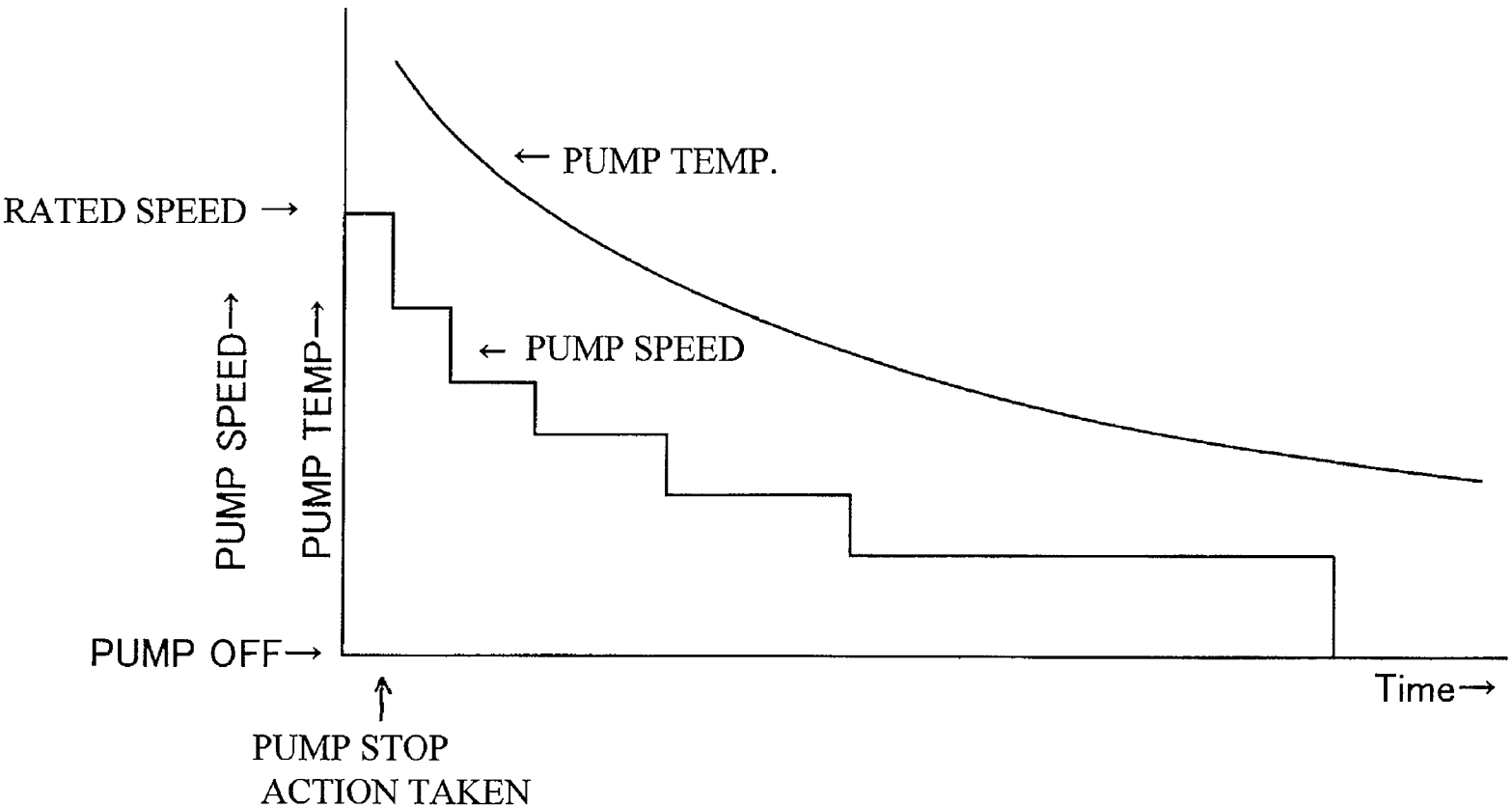
FIG. 7 is a chart showing a pump stop control pattern of the operation control device according to the invention.
Figure 10:
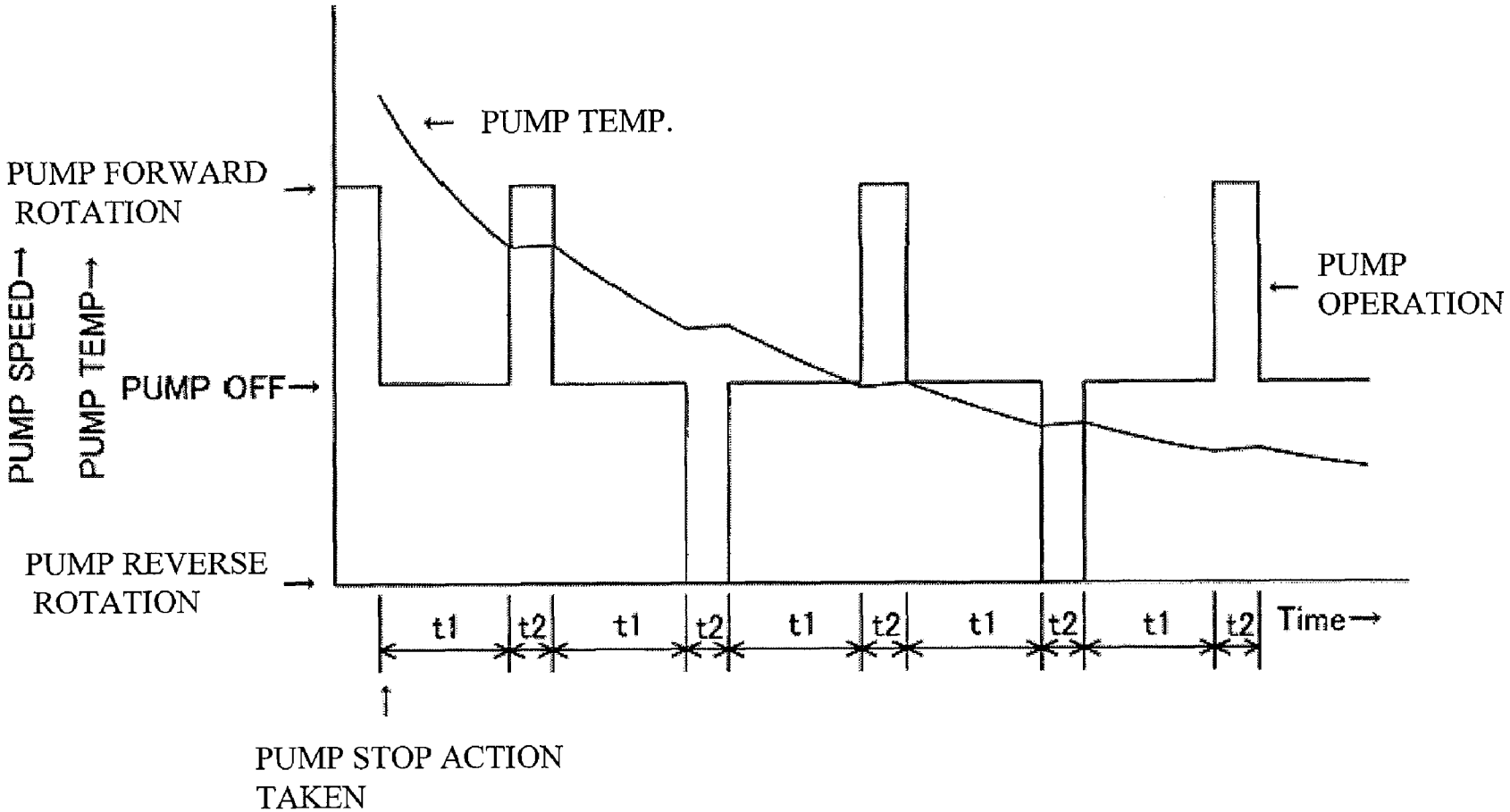
FIG. 10 is a chart showing a pump stop control pattern of the operation control device according to the invention.

In the pump rotor control section 15 is memorized a pump stop control pattern for the lapse of time when the operation of the vacuum pump is to be stopped as shown in FIG. 6 or 7. A pump stop action is taken by operating an operation stop switch (not shown) when the vacuum pump is in operation. According to the pump stop control pattern shown in FIG. 6, a speed reduction command signal is sent from the pump rotor control section 15 to the frequency converter 21 to reduce speed linearly with the lapse of time. The rotating speed of the vacuum pump (i.e. rotating speed of the pump rotors 1) decreases linearly. When a predetermined speed value is reached, the speed reduction command signal is suspended to stop the vacuum pump. According to the pump stop control pattern shown in FIG. 7, a speed reduction command signal is sent from the pump rotor control section 15 to the frequency converter 21 to reduce the speed, where the time duration of one step is made longer than that of the last step. The rotating speed of the vacuum pump decreases stepwise and the vacuum pump stops when a predetermined reduced speed is reached. In this embodiment too, like in the first embodiment, a pattern like that shown in FIG. 10 may be set according to which the electric motor 3 is operated in the order of forward rotation, stop, and forward rotation, repeated for several cycles.

While an induction motor is used as the electric motor 3 in the above embodiments, the induction motor may be replaced with a brushless DC motor on condition that the frequency conversion control section 24 is replaced with a brushless DC motor control section. In that case too, it is possible to rotate the pump rotors 1 based on the predetermined pattern as shown in FIGS. 4, 6, and 7, like when using the induction motor.

Figure 8:
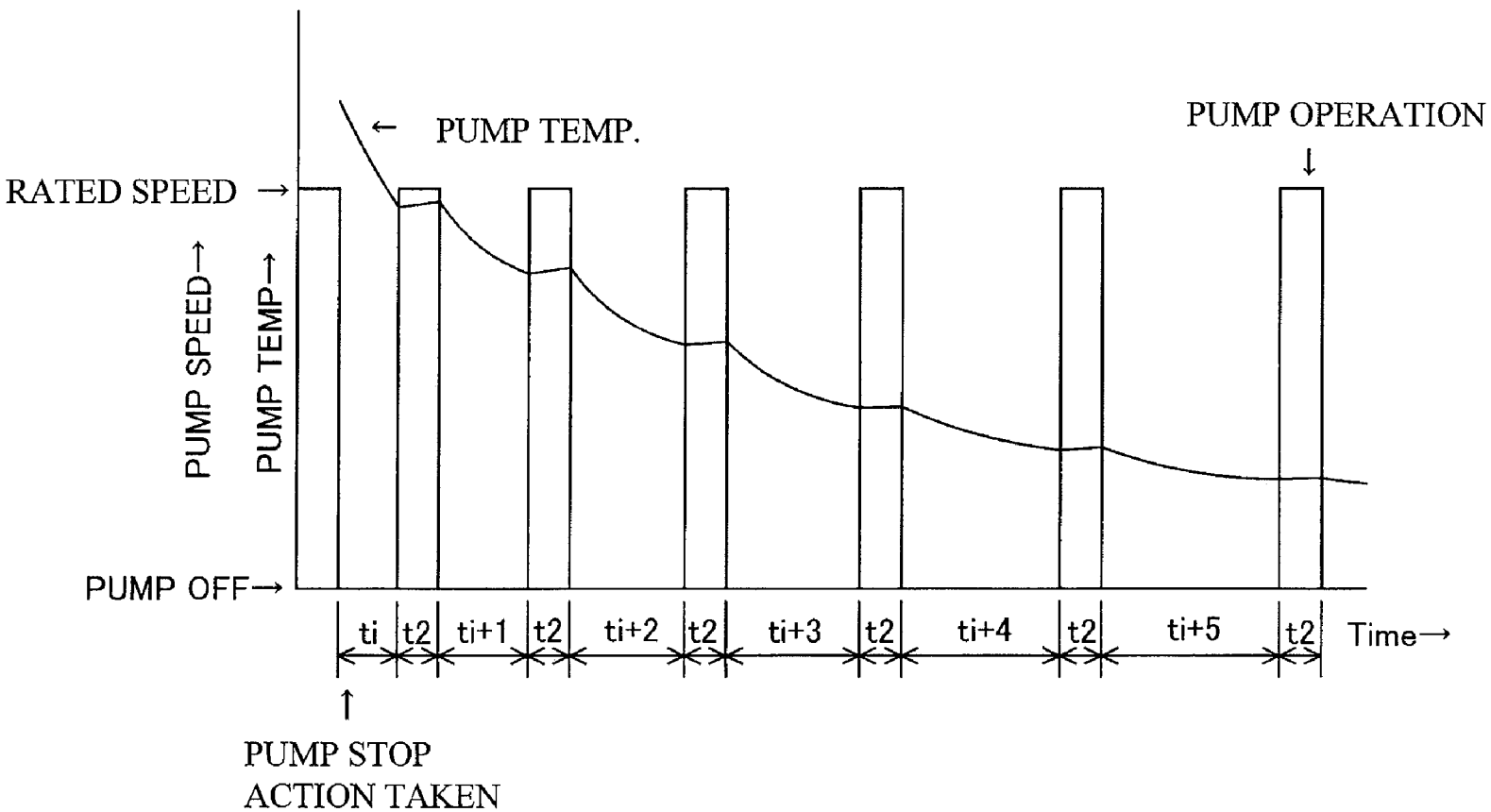
FIG. 8 is a chart showing a pump stop control pattern of the operation control device according to the invention.

Regarding the pump stop control patterns for stopping the vacuum pump operation, those patterns as shown in FIGS. 8 to 12 may be considered besides those shown in FIGS. 4, 6, and 7. According to FIG. 8, the pump is de-energized for a period of ti when a pump stop action is taken by operating the operation stop switch. When the period of ti lapses, the pump is energized for a period of t2. When the period of t2 lapses, the pump is de-energized for a period of ti+1. Thus, the period t2 for energizing the pump is made constant, while the periods ti, ti+1, ti+2, . . . for de-energizing the pump are made longer with the lapse of time. In other words, intervals of de-energizing the pump are made short in the early stage (high temperature state) immediately after the pomp stop action is taken in which pump temperature decreases rapidly; and the intervals are made long in low temperature state. This may be brought about by setting a pattern expressed in a numerical value table as shown in FIG. 8 in the pump rotor control section 15.

Figure 9:
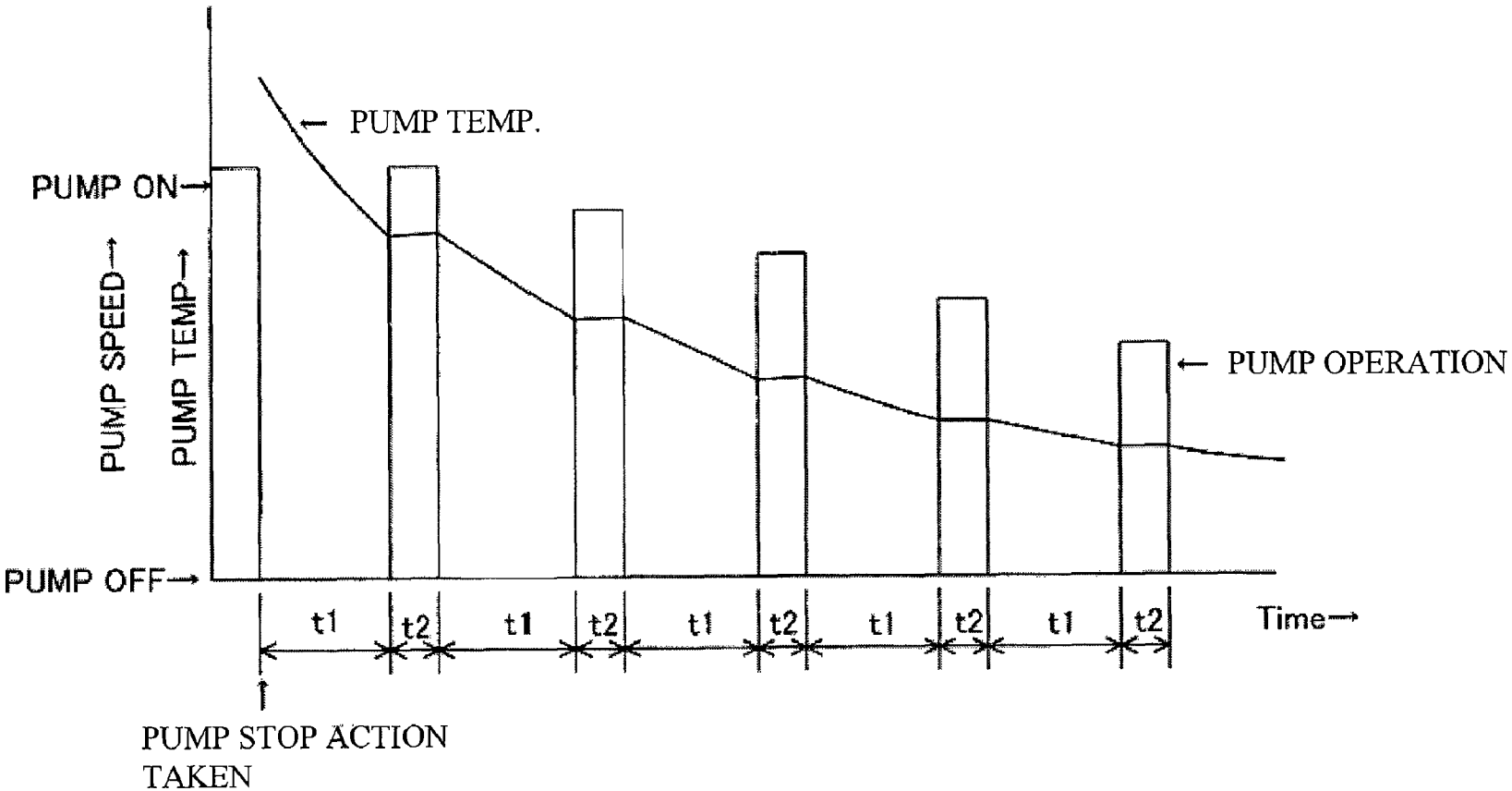
FIG. 9 is a chart showing a pump stop control pattern of the operation control device according to the invention.

According to FIG. 9, the period t1 for de-energizing the pump and the period t2 for energizing the pump are both made constant, allowing the rotating speed of the pump or the rotating speed of the pump rotors 1 to decrease with the lapse of time after a pump stop action is taken. According to FIG. 10, the pump is rotated for a predetermined operation period of t2 alternately in forward or reverse direction every time a constant period of t1 lapses. As a result, rotary forces of the pump rotors are applied to the products from different directions, so that the products become more likely to crumble and easy to remove.

Figure 11:
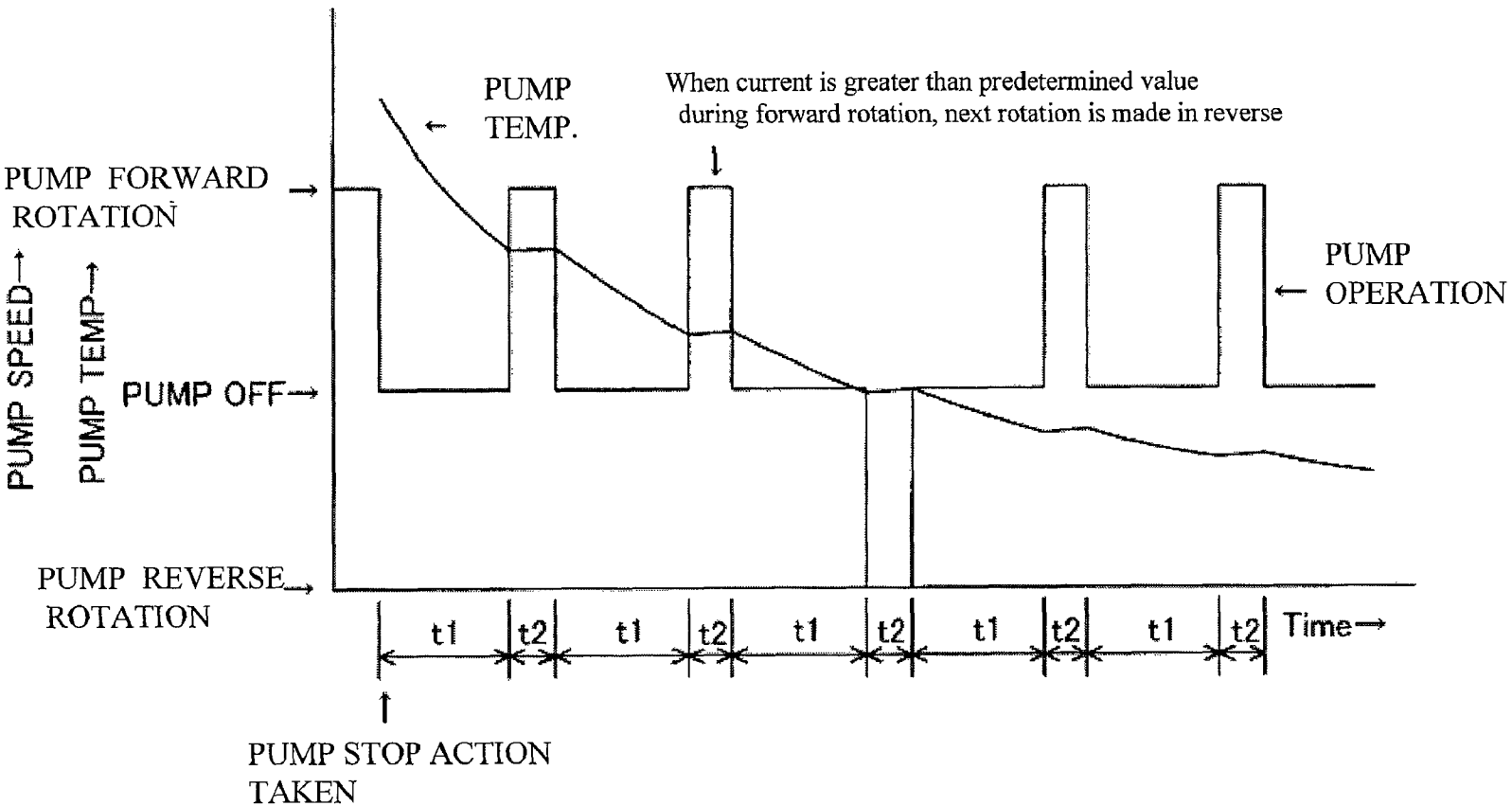
FIG. 11 is a chart showing a pump stop control pattern of the operation control device according to the invention.
Figure 12:
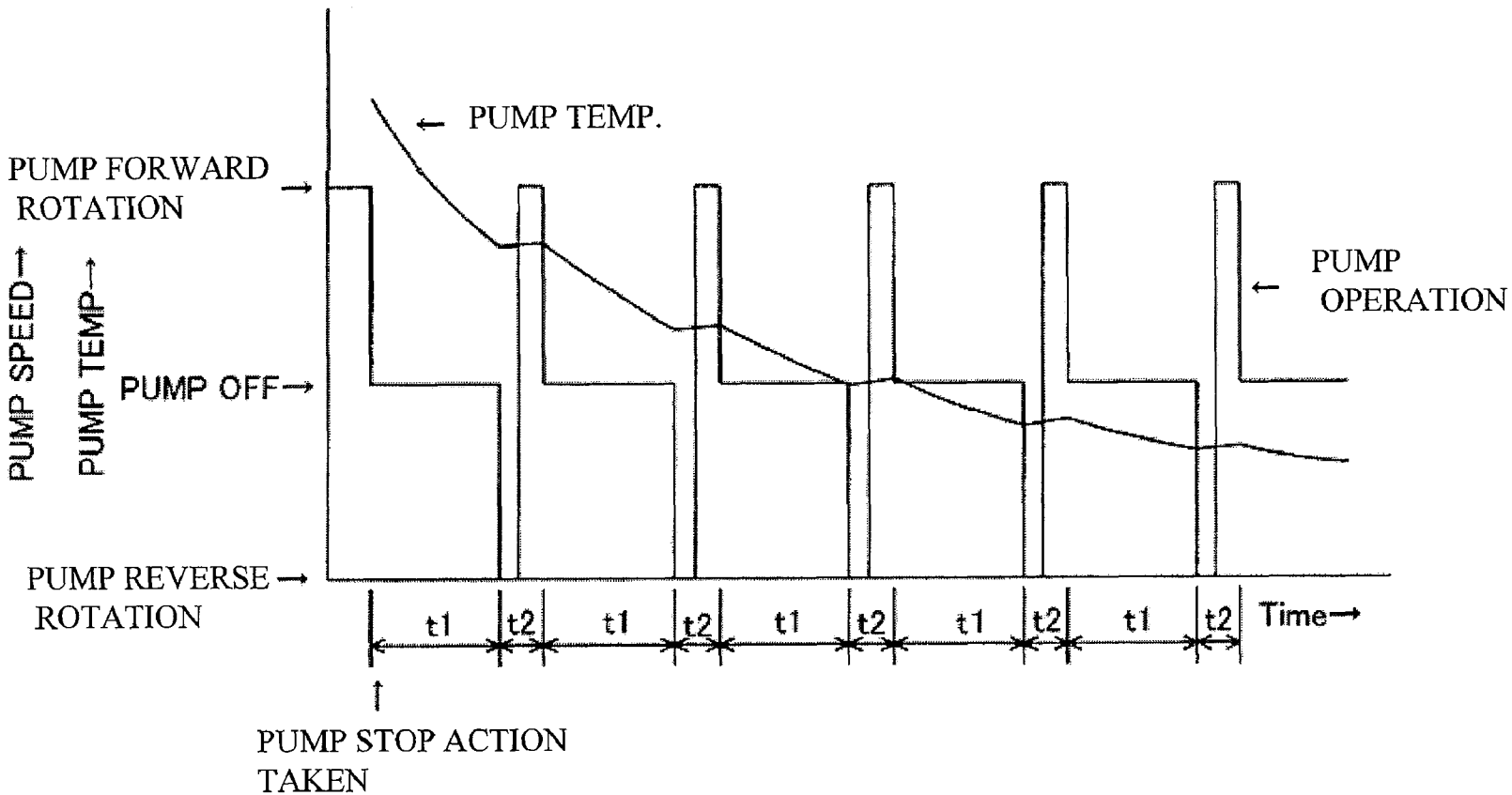
FIG. 12 is a chart showing a pump stop control pattern of the operation control device according to the invention.

According to FIG. 11, the period t1 for de-energizing the pump and the period t2 for energizing the pump are both made constant. After a pump stop action is taken, the electric motor is rotated in the forward direction for several times (twice in FIG. 11). If the then current in the electric motor 3 is greater than a predetermined value, it is deemed that the products cannot be removed by forward rotation. Then, the pump rotors 1 are rotated in the reverse direction to scrape off the products. The pump stop control repeats the above steps until the current of the electric motor decreases below a predetermined value. According to FIG. 12, forward and reverse rotations of the pump rotors 1 are made in succession within a pump energizing period (or a pump operation period) of t2, followed by a pump de-energizing period of t1. This cycle is repeated to apply rotary forces of the rotors 1 in forward and reverse rotary directions to the products within the period of t2 and scrape off the products.

Figure 13:
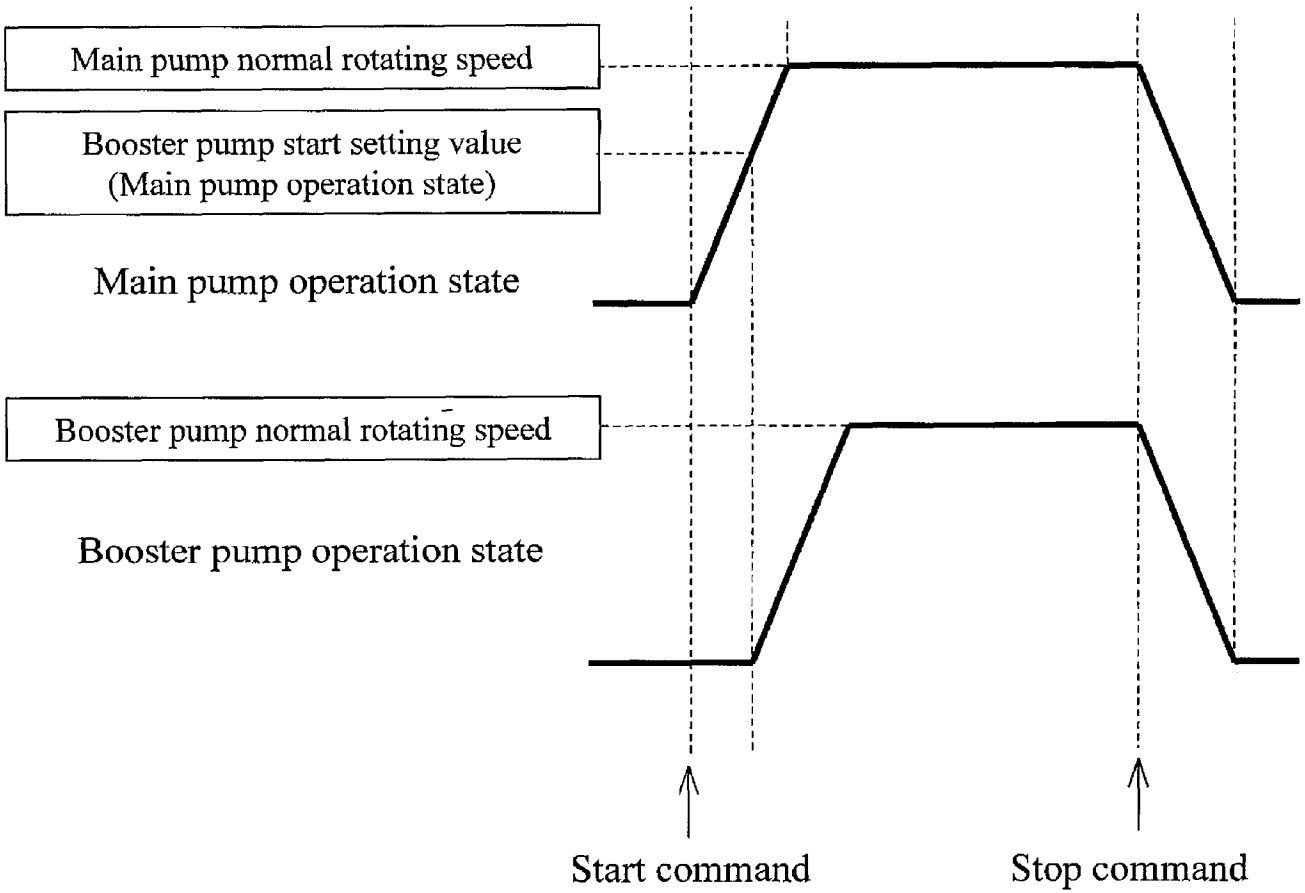
FIG. 13 is a chart of control pattern for start and stop of a main pump and a booster pump for evacuating the chamber of a semiconductor manufacturing apparatus.

To evacuate gas in the chamber of the semiconductor manufacturing apparatus, a main pump MP and a booster pump BP are connected in series to the chamber. When a start command is given, as shown in FIG. 13, the main pump MP is started first. When the rotating speed of the main pump MP reaches a predetermined value, the booster pump BP is started. When a stop command is given, an action is taken to stop the main pump MP and the booster pump BP simultaneously. After the action to stop the main pump MP and the booster pump BP is taken, the operation of the main pump MP and the booster pump BP is controlled according to the above-mentioned pump stop control pattern. As a result, products in the main pump MP and the booster pump BP are efficiently removed, so that the main pump MP and the booster pump BP may be started smoothly.

While embodiments of this invention are described above, this invention is not limited to the embodiments and may be modified in various ways within the scope of the technical ideas described in the claims, the specification and the drawings. For example, it is possible to pre-store a plural number of pump stop control patterns in a plural number of pump rotor control sections 15, so that an appropriate pump stop control pattern matching the kind of gas to be evacuated from the chamber may be chosen out of the plural number of pump stop control patterns to take an action to stop the operation of the vacuum pump.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

1: pump rotor
2: casing

3: electric motor
4: shaft
5: bearing
6: timing gear
7: evacuation chamber
10: operation control device
11: 3-phase power source
12: electric leakage breaker (ELB)
13: electromagnetic contactor
14: thermal protector
15: pump rotor control section
16: timer
21: frequency converter
22: rectifier
23: power transistor section
24: frequency conversion control section

What is claimed is:

1. A vacuum pump for evacuating a gas containing constituents that solidify or liquefy at low temperature from a process chamber, comprising:

a casing having a suction port and an exhaust port;

a pair of pump rotors rotatably disposed in the casing;

a motor to rotate the pair of pump rotors;

a shutdown device having a pump rotor control section which controls rotating and stopping of the pair of pump rotors, the pump rotor control section having a timer and memorizing a pump stop control pattern; and a shutdown switch connected to the shutdown device for taking a shutdown action:

wherein the pump rotor control section provides the motor with a command for repeating a cycle of stopping for a period of t1 and operating for a period of t2 according to the shutdown control pattern using the timer, when the shutdown action is taken by operating the shutdown switch.

2. A vacuum pump according to claim 1, wherein the period of t2 for energizing the motor is constant, and the period of t1 for dc-energizing the motor are made longer with a lapse of time.

3. A vacuum pump according to claim 1, wherein both of the period of t2 for energizing the motor and the period of t1 for de-energizing the motor are constant respectively, wherein the rotating speed of the pump rotor are made lower with a lapse of time.

* * * * *